US010726785B2

(12) United States Patent
Kim et al.

(10) Patent No.: US 10,726,785 B2
(45) Date of Patent: Jul. 28, 2020

(54) OLED DISPLAY DEVICE AND OPTICAL COMPENSATION METHOD THEREOF

(71) Applicant: LG Display Co., Ltd., Seoul (KR)

(72) Inventors: Jin-Won Kim, Goyang-si (KR); Moo-Kyoung Hong, Changwon-si (KR)

(73) Assignee: LG Display Co., Ltd., Seoul (KR)

( * ) Notice: Subject to any disclaimer, the term of this patent is extended or adjusted under 35 U.S.C. 154(b) by 26 days.

(21) Appl. No.: 15/993,880

(22) Filed: May 31, 2018

(65) Prior Publication Data

US 2018/0350305 A1 Dec. 6, 2018

(30) Foreign Application Priority Data

Jun. 1, 2017 (KR) ..... 10-2017-0068197

(51) Int. Cl.

| | |
|---|---|
| ***G09G 3/3258*** | (2016.01) |
| ***G09G 3/00*** | (2006.01) |
| ***G09G 3/3233*** | (2016.01) |
| ***G09G 3/20*** | (2006.01) |

(52) U.S. Cl.

CPC ..... *G09G 3/3258* (2013.01); *G09G 3/006* (2013.01); *G09G 3/20* (2013.01); *G09G 3/3233* (2013.01); *G09G 2310/08* (2013.01); *G09G 2320/0204* (2013.01); *G09G 2320/0223* (2013.01); *G09G 2330/02* (2013.01); *G09G 2330/021* (2013.01); *G09G 2370/22* (2013.01)

(58) Field of Classification Search

CPC ..... G09G 3/3258; G09G 3/3614

See application file for complete search history.

(56) References Cited

U.S. PATENT DOCUMENTS

| | | | | |
|---|---|---|---|---|
| 9,157,951 | B1 * | 10/2015 | Jiang | G01R 31/2834 |
| 2009/0207106 | A1 * | 8/2009 | Mizukoshi | G09G 3/3233 345/76 |
| 2010/0073560 | A1 * | 3/2010 | Kitano | G09G 5/006 348/554 |
| 2010/0201673 | A1 * | 8/2010 | Kim | G09G 3/3225 345/211 |
| 2014/0225851 | A1 * | 8/2014 | Saitoh | G06F 3/041 345/173 |
| 2017/0309221 | A1 * | 10/2017 | Yang | G09G 3/2096 |

* cited by examiner

*Primary Examiner* — Kevin M Nguyen

(74) *Attorney, Agent, or Firm* — Morgan, Lewis & Bockius LLP

(57) ABSTRACT

Disclosed herein are an organic light emitting diode (OLED) display device and an optical compensation method thereof, The OLED display device is capable of automatically performing optical compensation according to the use environment of a user in correspondence with voltage drop upon utilizing an additional cable for extending a connection length in the display device in which a display module and a driver are separated. The driver includes a memory for storing optical compensation data according to a length of a cable connecting the display module and the driver, a cable checking unit for checking whether an extension cable is used, and a timing controller for selectively applying the optical compensation data stored in the memory according to a result output from the cable checking unit.

8 Claims, 7 Drawing Sheets

OLED DISPLAY DEVICE AND OPTICAL COMPENSATION METHOD THEREOF

This application claims the benefit of Korean Patent Application No. 10-2017-0068197, filed on Jun. 1, 2017, which is hereby incorporated by reference as if fully set forth herein.

BACKGROUND

Technical Field

The present disclosure relates to an organic light emitting diode (OLED) display device and, more particularly, to an OLED display device capable of coping with voltage drop when an additional cable for extending a connection length is used in the display device in which a display module and a driver are separated, and an optical compensation method thereof.

Discussion of the Related Art

An organic light emitting diode (OLED) display device includes an OLED, which is a self-luminescent device, in a pixel. The OLED display device may have lower power consumption and smaller thickness than a liquid crystal display device requiring a backlight. In addition, the OLED display device also has a wide viewing angle and a high response speed. The market for OLED display devices is being expanded by developing process technology up to large-screen mass production technology to compete with liquid crystal display devices.

FIG. 1 is a circuit diagram illustrating the pixel structure of a general OLED display device. Referring to FIG. 1, each pixel of a display panel includes a first switching TFT ST1, a second switching TFT ST2, a driving TFT DT, a capacitor Cst and an organic light emitting diode OLED.

The first switching TFT ST1 is switched according to a scan signal scan (or a gate signal) supplied to a gate line GL to supply a data voltage Vdata supplied to a data line DL to the driving TFT (DT).

The driving TFT (DT) is switched according to the data voltage Vdata received from the first switching transistor ST1 to control data current Ioled flowing from a first driving power supply VDD for supplying power to a power line PL to the organic light emitting diode OLED.

The capacitor Cst is connected between gate and source terminals of the driving TFT DT to store a voltage corresponding to the data voltage Vdata supplied to the gate terminal of the driving TFT DT and to turn the driving TFT DT on with the stored voltage.

A sensing signal line SL formed in the same direction as the gate line GL is also included. The second switching TFT ST2 is switched according to a sense signal sense applied to the sensing signal line SL to supply data current Ioled supplied to the organic light emitting diode OLED to an analog-to-digital converter (ADC) of a drive IC.

The organic light emitting diode OLED is electrically connected between the source terminal of the driving TFT DT and a cathode power supply VSS to emit light by the data current Ioled received from the driving TFT DT.

Each pixel of the conventional OLED display device controls the level of the data current Ioled flowing from the first driving power supply VD to the organic light emitting diode OLED using switching of the driving TFT DT according to the data voltage Vdata to cause the organic light emitting diode OLED to emit light, thereby displaying a predetermined image.

However, there is a problem that the threshold voltage Vth or mobility of the driving TFT DT and the characteristics of the organic light emitting diode OLED vary from pixel to pixel depending on the non-uniformity of the TFT manufacturing process. Accordingly, in a general OLED display device, even if the same data voltage Vdata is applied to the driving TFT DT of each pixel, a uniform image quality cannot be realized due to a variation in current flowing in the organic light emitting diode OLED.

In order to improve unevenness of the threshold voltage Vth or mobility of the driving TFT DT and the characteristics of the organic light emitting diode OLED due to the deviation of the manufacturing process, before shipment of OLED display devices, the threshold voltages Vth or mobility of the driving TFTs DT and the characteristics of the organic light emitting diodes OLEDs of all pixels are sensed to generate the sensing data.

Recently, as shown in FIG. 2, a display device in which a display module 10 and a driver 20 are separated has been developed. In order to decrease the thickness of the display module 10, the driver 20 is separated from the display module 10.

FIG. 3 is a diagram showing a luminance measurement unit of a pixel used for measuring a characteristic deviation of a driving TFT in each pixel using a camera or an optical scanner. As shown in FIG. 3, a data voltage is supplied to the pixels of the display panel to cause the OLEDs of the pixels to emit light and the luminance of each pixel is photographed by the camera 30. An algorithm for measuring the luminance of each pixel from the image obtained by the camera is known. The luminance of each pixel may be measured from the image obtained by the camera 30. The camera 30 may move in a predetermined scan direction at a distance close to the display panel and simultaneously measure the luminance of the pixels disposed in one line of a pixel array.

Thereafter, the measured information is analyzed using a luminance meter 40 and compensation data corresponding to the threshold voltages Vth or mobility of the driving TFTs DT and the characteristics of the OLEDs of all pixels P are generated. Thereafter, the compensation data is stored in the memory EEPROM of a timing controller T-con included in the driver 20.

Upon utilizing such a display, an extension cable may be used in addition to an FPC cable which is a basic cable for connecting the display module and the driver. That is, a distance between the display module and the driver may become greater than a basic setting distance. At this time, resistance increases and voltage drop occurs due to increase in cable length. To this end, optical compensation data stored in the memory of the driver is not suitable and thus optical compensation is not properly performed.

SUMMARY

Accordingly, embodiments of the present disclosure are directed to an OLED display device and an optical compensation method thereof that substantially obviate one or more of the problems due to limitations and disadvantages of the related art.

An object of the present disclosure is to provide an OLED display device capable of solving problems occurring due to use of an additional cable in the OLED display device in which a display module and a driver are separated, and an optical compensation method thereof.

Another object of the present disclosure is to provide an OLED display device having an optical compensation function capable of coping with voltage drop in the OLED display device in which a display module and a driver are separated, and an optical compensation method thereof.

Another object of the present disclosure is to provide an OLED display device capable of automatically performing optical compensation according to a use environment of a user in the OLED display device in which a display module and a driver are separated, and an optical compensation method thereof.

Additional features and aspects will be set forth in the description that follows, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described herein, an organic light emitting diode (OLED) display device comprises a display module including a display panel, a gate driver and a data driver, and a driver spaced apart from the display module to drive the display module. The driver includes a memory for storing optical compensation data according to a length of a cable connecting the display module and the driver, a cable checking unit for checking whether an extension cable is used, and a timing controller for selectively applying the optical compensation data stored in the memory according to a result output from the cable checking unit.

In an exemplary embodiment of the present invention, optical compensation data according to a length of a basic cable and optical compensation data considering voltage drop due to use of an extension cable are stored at different addresses of the memory connected to the timing controller.

In an exemplary embodiment of the present invention, the optical compensation data includes a plurality of data considering voltage drop according to the lengths of various extension cables.

In an exemplary embodiment of the present invention, a pin is added to a basic cable and whether an extension cable is used is determined depending on whether a status checking signal is received through the added pin.

In an exemplary embodiment of the present invention, the timing controller controls the cable checking unit to check whether the extension cable is used and then outputs a control signal for selecting corresponding optical compensation data to supply power to the display module.

In another aspect, an optical compensation method of an organic light emitting diode (OLED) display device in which a display module and a driver are separated comprises checking whether an extension cable is used, reading optical compensation data depending on whether the extension cable is used, and applying the read optical compensation data and supplying power to the display module.

The optical compensation method may further include, prior to the checking, calculating and storing optical compensation data according to a length of a basic cable in a memory of the driver, and calculating and storing optical compensation data considering voltage drop due to use of the extension cable in the memory.

In the optical compensation method, the checking may include determining that the extension cable is not used, when a status checking signal is received through a pin added to a basic cable, and determining that the extension cable is used, when the status checking signal is not received through a dummy cable connected to the pin added to the basic cable.

It is to be understood that both the foregoing general description and the following detailed description of the present invention are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain various principles. In the drawings.

DETAILED DESCRIPTION

Figure 1:
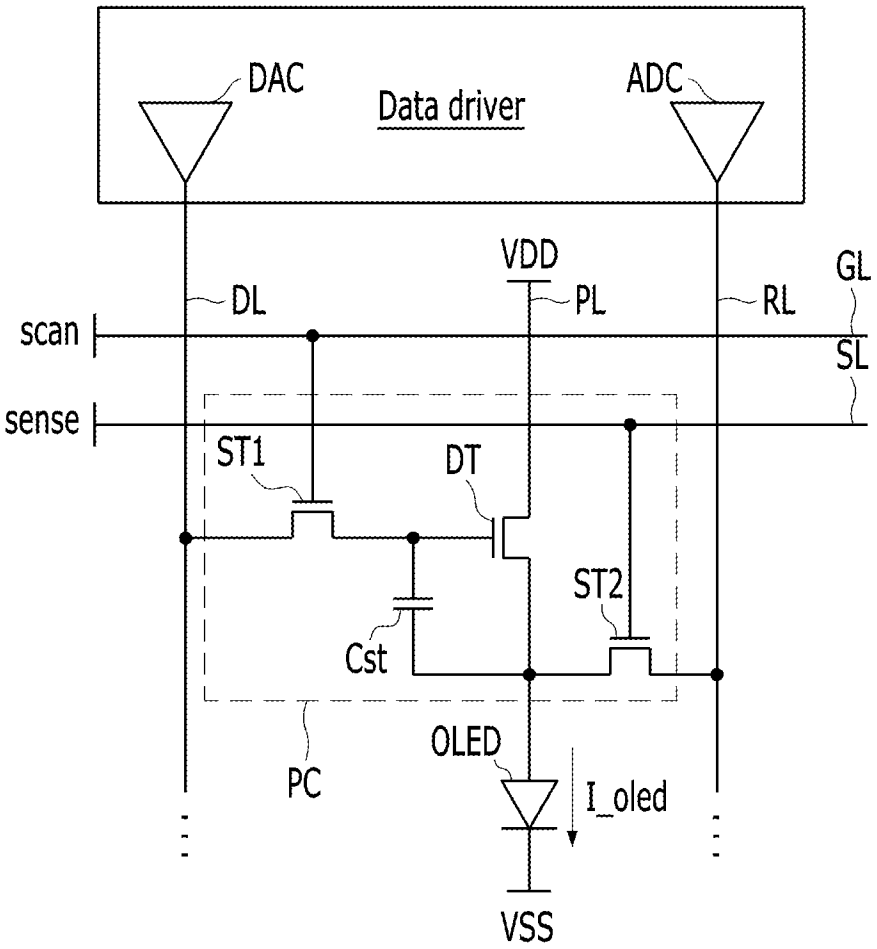
FIG. 1 is a circuit diagram illustrating the pixel structure of a conventional OLED display device.
Figure 2:
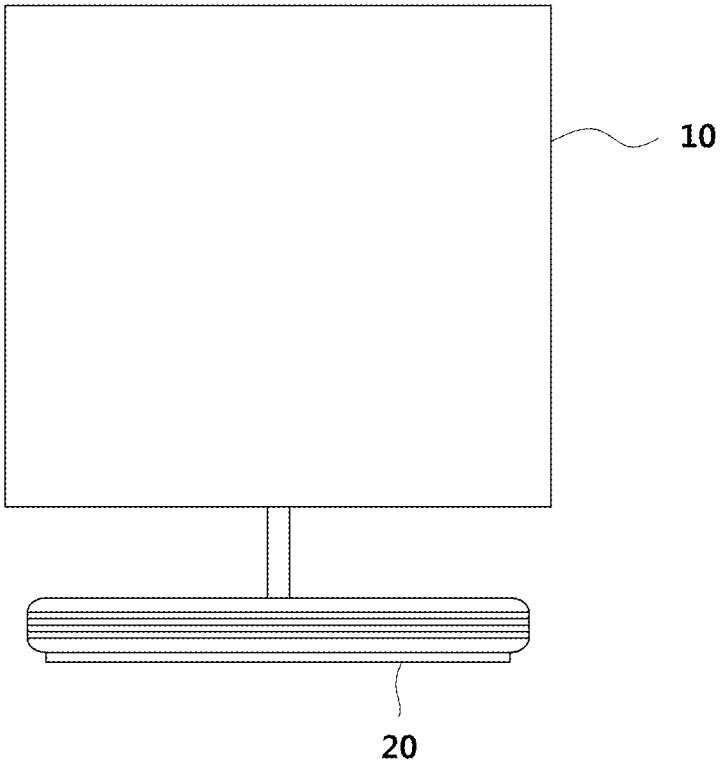
FIG. 2 is a diagram showing a display device in which a display module and a driver are separated.
Figure 3:
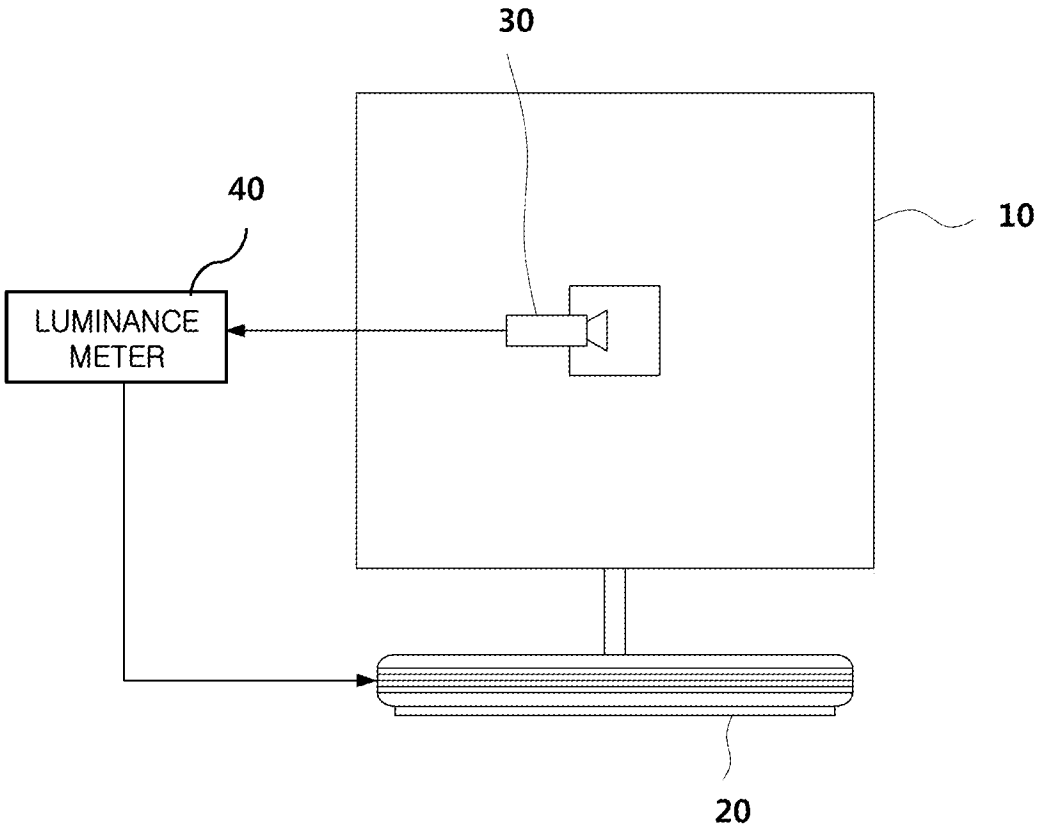
FIG. 3 is a diagram showing a luminance measurement unit of a pixel used for measuring a characteristic deviation of a driving TFT in each pixel using a camera or an optical scanner.

Specific structures or functions are described for the purpose of explaining the embodiments of the present invention and the embodiments of the present invention may be implemented in a variety of forms and should not be limited to the embodiments disclosed herein.

Since the present invention may be variously modified and have several exemplary embodiments, specific exemplary embodiments will be shown in the accompanying drawings and be described in detail. However, it is to be understood that the present invention is not limited to the specific exemplary embodiments, but includes all modifications, equivalents, and substitutions within the spirit and the scope of the present invention.

Terms such as "first", "second", etc., may be used to describe various components, but the components are not to be construed as being limited to the terms. The terms are used only to distinguish one component from another component. For example, the "first" component may be called a "second" component and the "second" component may also be similarly called a "first" component, without departing from the scope of the present invention.

It is to be understood that when one element is referred to as being "connected to" or "coupled to" another element, it may be connected directly to or coupled directly to another element or be connected to or coupled to another element, having the other element interposed therebetween. On the other hand, it is to be understood that when one element is referred to as being "connected directly to" or "coupled directly to" another element, it may be connected to or coupled to another element without another element interposed therebetween. Other expressions describing a relationship between components, that is, "between," "directly between," "neighboring," "directly neighboring" and the like, should be similarly interpreted.

Terms used in the present specification are used only in order to describe specific exemplary embodiments rather than limiting the present invention. Singular forms used herein are intended to include plural forms unless explicitly indicated otherwise. It will be further understood that the terms "comprises" or "have" used in this specification, specify the presence of stated features, steps, operations, components, parts, or combinations thereof, but do not preclude the presence or addition of one or more other features, numerals, steps, operations, components, parts, or combinations thereof.

Unless indicated otherwise, it is to be understood that all terms used in the specification including technical and scientific terms have the same meaning as understood by those who skilled in the art. It must be understood that the terms defined by the dictionary are identical with the meanings within the context of the related art, and they should not be ideally or excessively formally defined unless context clearly dictates otherwise.

On the other hand, if an embodiment is otherwise implemented, the functions or operations specified in particular blocks may be performed in an order different from the order specified in the flowchart. For example, two consecutive blocks may actually be performed substantially concurrently, and the blocks may be performed backwards depending on the associated function or operation.

Hereinafter, exemplary embodiments of the present invention will be described in detail with reference to the accompanying drawings.

Figure 4:
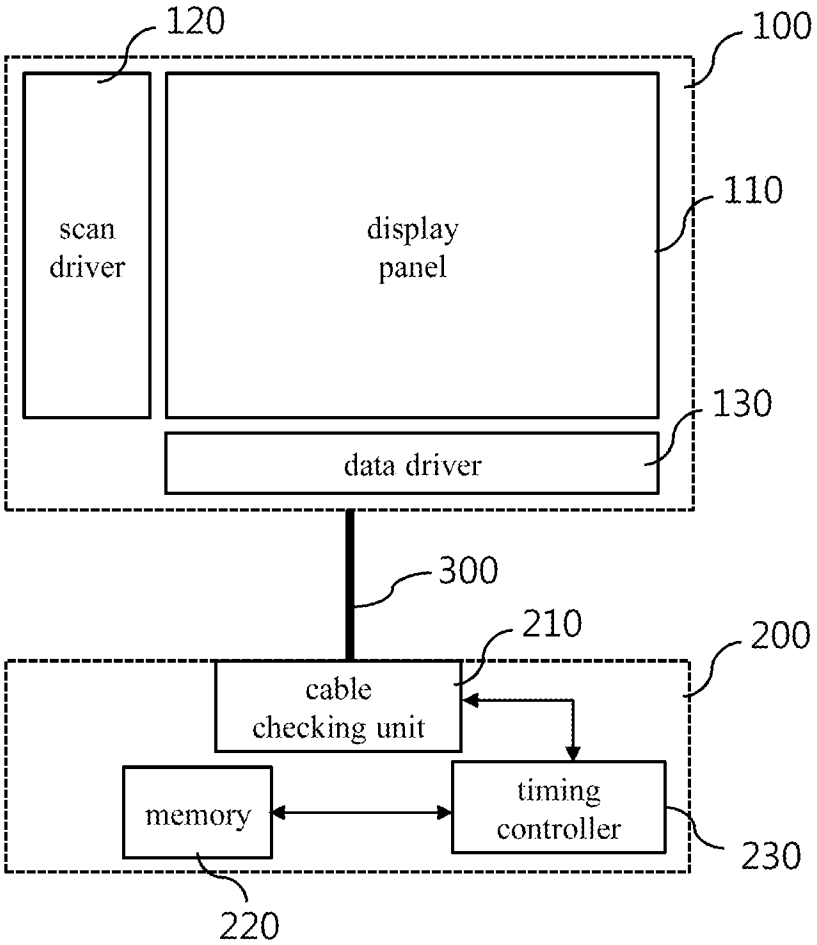
FIG. 4 is a block diagram schematically showing the configuration of an OLED display device according to the present invention.

FIG. 4 is a block diagram schematically showing the configuration of an OLED display device according to the present invention.

As shown in the figure, the OLED display device according to the present invention roughly includes a display module 100, a driver 200 and a signal cable 300.

The display module 100 includes a display panel 110 on which a plurality of data lines and a plurality of gate lines are disposed and a plurality of subpixels are disposed in a matrix, a gate driver 120 for sequentially supplying scan signals to the plurality of gate lines to sequentially drive the plurality of gate lines, and a data driver 130 for supplying data voltages to the plurality of data lines to drive the plurality of data lines.

The driver 200 is spaced apart from the display module 100 to provide a power signal and a control signal for driving the display module 100 through the signal cable 300. The driver 200 includes a cable checking unit 210 for determining whether an extension cable is used, a memory 220 for storing optical compensation data according to the length of a cable connecting the display module 100 and the driver 200, and a timing controller 230 for selectively applying the optical compensation data stored in the memory 220 according to the output result of the cable checking unit 210.

The timing controller 230 supplies various control signals to the gate driver 120 and the data driver 130 to control the gate driver 120 and the data driver 130. The timing controller 230 starts scanning according to timing of each frame, converts externally input image data into a data signal format used in the data driver 130 to output the converted image data, and controls data driving according to scanning.

The gate driver 120 sequentially supplies scan signals of an ON voltage or OFF voltage to the plurality of gate lines to sequentially drive the plurality of gate lines under control of the timing controller 230. The gate driver 120 may be referred to as a scan driver. The gate driver 120 may be located at one side or both sides of the display panel 100 according to a driving method. In addition, the gate driver 120 may include one or more gate driver integrated circuits. Each gate driver integrated circuit may be connected to a bonding pad of the display panel 110 using a tape automated bonding (TAB) method or a chip on glass (COG) method or is implemented in a gate-in-panel (GIP) type to be directly disposed on the display panel 110. In some cases, the gate driver integrated circuit may be integrated and disposed on the display panel 110. Each gate driver integrated circuit may include a shift register, a level shifter, or the like.

When a specific gate line is opened, the data driver 130 converts the image data received from the timing controller 230 into an analog data voltage and supplies the converted analog data voltage to the data lines, thereby driving the plurality of data lines. The data driver 130 may include at least one source driver integrated circuit to drive the plurality of data lines. Each source driver integrated circuit may be connected to a bonding pad of the display panel 110 using a tape automated bonding (TAB) method or a chip on glass (COG) method or is implemented in a gate-in-panel (GIP) type to be directly disposed on the display panel 110. In some cases, the source driver integrated circuit may be integrated and disposed on the display panel 110. Each source driver integrated circuit may be implemented using a chip on film (COF) method. In this case, one end of each source driver integrated circuit is bonded to at least one source printed circuit board and the other end thereof is bonded to the display panel 110. Each source driver integrated circuit may include a logic unit including a shift register, a latch circuit or the like, a digital-to-analog converter (DAC), an output buffer, etc. In some cases, a sensing unit (sensor) for sensing the characteristics of a subpixel may be further included in order to compensate for the characteristics of the subpixel (e.g., the threshold voltage and mobility of a driving transistor, the threshold voltage of an OLED, the luminance of the subpixel, etc.).

The timing controller 230 receives various timing signals including a vertical synchronization signal Vsync, a horizontal synchronization signal Hsync, an input data enable (DE) signal and a clock signal CLK from the outside (e.g., a host system), along with the input image data.

The timing controller 230 not only converts the input image data received from the outside into a data signal format used in the data driver 130 and outputs the converted image data but also receives timing signals including the vertical synchronization signal Vsync, the horizontal synchronization signal Hsync, the input DE signal and the clock signal CLK and generates and outputs various control signals to the gate driver 120 and the data driver 130, in order to control the gate driver 120 and the data driver 130.

For example, the timing controller 230 outputs various gate control signals GCS including a gate start pulse GSP, a gate shift clock GSC, a gate output enable (GOE) signal, etc. in order to control the gate driver 120. The gate start pulse GSP controls operation start timing of one or more gate driver integrated circuits. The gate shift clock GSC is a clock signal commonly input to one or more gate driver integrated circuits to control shift timing of the scan signal (gate pulse). The gate output enable (GOE) signal specifies the timing information of one or more gate driver integrated circuits.

The timing controller 230 outputs various data control signals DCS including a source start pulse SSP, a source sampling clock SSC, a source output enable SOE signal, etc.

in order to control the data driver 130. The source start pulse SSP controls data sampling start timing of one or more source driver integrated circuits configuring the data driver 120. The source sampling clock SSC is a clock signal for controlling the sampling timing of data in each source driver integrated circuit. The source output enable (SOE) signal controls the output timing of the data driver 130.

Each of the plurality of subpixels disposed on the display panel 110 according to the present invention may include an organic light emitting diode (OLED), a driving transistor (DRT) for driving the OLED, and a storage capacitor.

Figure 5:
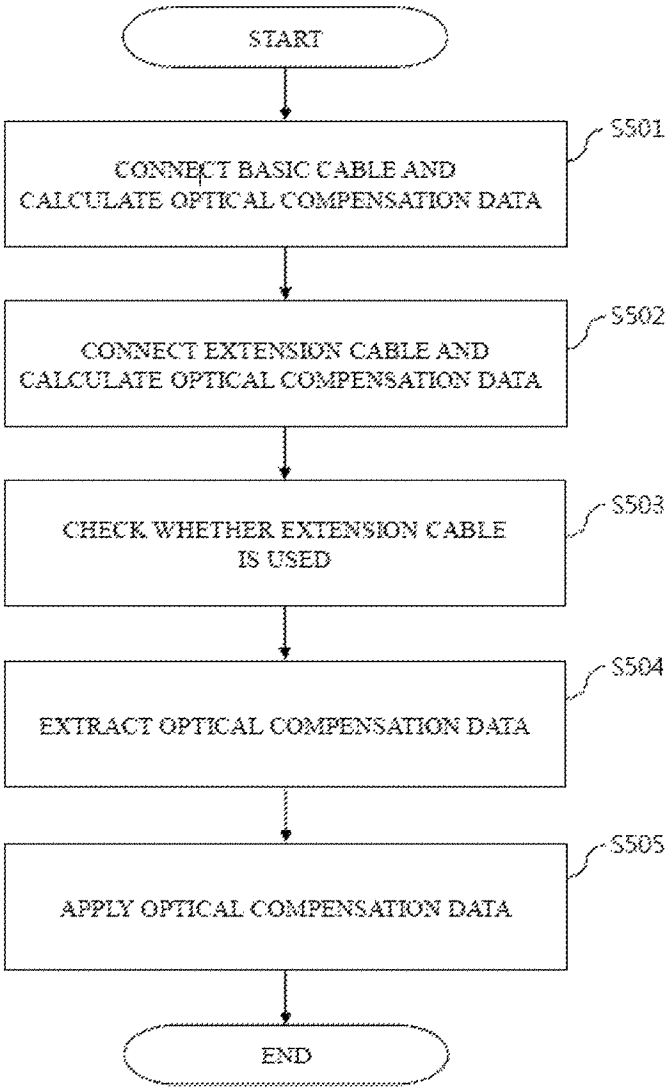
FIG. 5 is a flowchart illustrating an optical compensation method of an OLED display device according to the present invention.

FIG. 5 is a flowchart illustrating an optical compensation method of an OLED display device according to the present invention.

Optical compensation data according to the length of a basic cable is calculated and stored in the memory 220 of the driver 200. That is, when an FPC cable is used as a basic cable, the luminance of each pixel of the display panel is measured and the optical compensation data is calculated and stored in the memory as a basic value (S501).

An extension cable is connected to the basic cable. That is, a harness cable, which is an extension cable, is connected to the FPC cable, which is the basic cable. Optical compensation data considering voltage drop due to connection of the extension cable is calculated and stored at a different address in the memory. At this time, the length of the extension cable may be various and a variety of optical compensation data may be stored in the memory in correspondence with various lengths of the extension cable (S502).

The OLED display device according to the present invention may be shipped with a plurality of optical compensation data stored in the memory of the driver.

The optical compensation method of the OLED display device according to the present invention is automatically performed upon applying power to the driver 200 in order to use the OLED display device in which the display module 100 and the driver 200 are separated.

When power is applied to the driver 200 of the display device, the timing controller 230 sends a control signal to the cable checking unit 210 to check whether the extension cable is used. That is, whether the signal transmission cable between the display module 100 and the driver 200 is a basic cable or an extension cable connected to the basic cable is determined. As a method of checking whether the extension cable is used, various methods may be used. In the following description, an example of the method of checking whether the extension cable is used will be described (S503).

The timing controller 230 receives the result checked by the cable checking unit 210 and reads the optical compensation data stored in the memory 220 according to the result. That is, upon determining that the extension cable is not connected, the optical compensation data due to use of the basic cable is read. Upon determining that the extension cable is used, information corresponding to the optical compensation data due to use of the extension cable is read (S504).

Subsequently, the timing controller 230 applies the read optical compensation data and supplies power to the display module 100. That is, optical compensation data due to extension of the basic cable or optical compensation data considering voltage drop due to the extended cable length is selectively applied to perform optimal optical compensation. Accordingly, even when voltage drop occurs due to connection of the extension cable, optimal luminance is realized in the pixel of the display module (S505).

Figure 6:
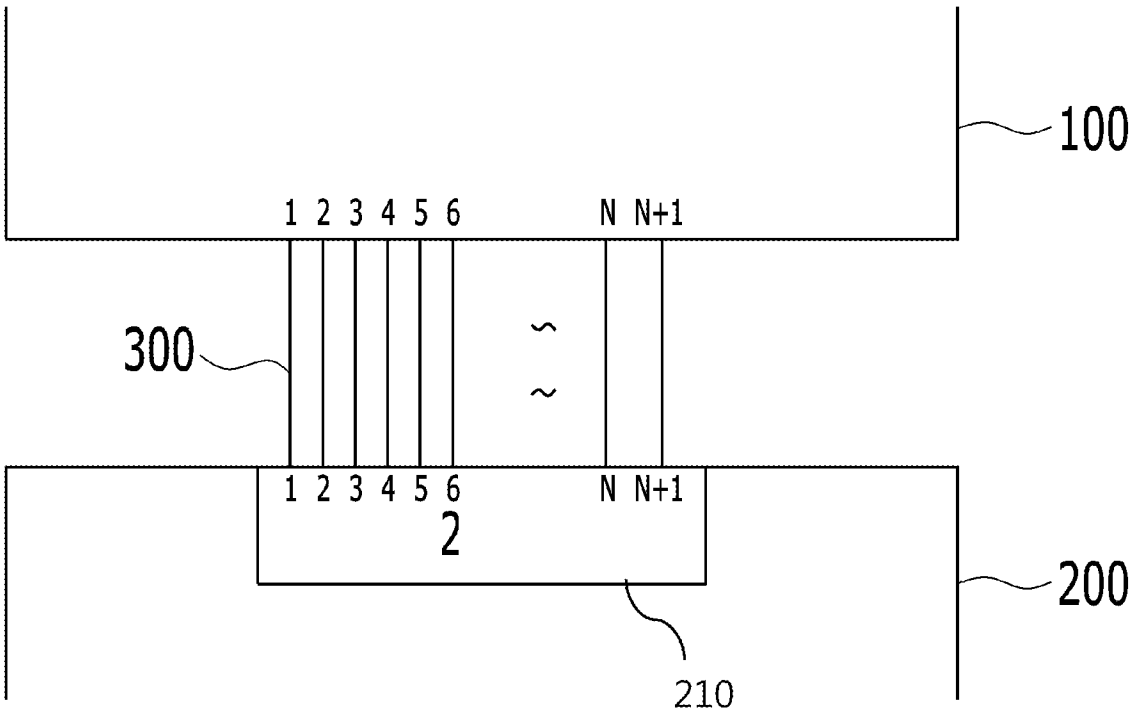
FIGS. 6 and 7 are diagrams illustrating operation of a cable checking unit.
Figure 7:
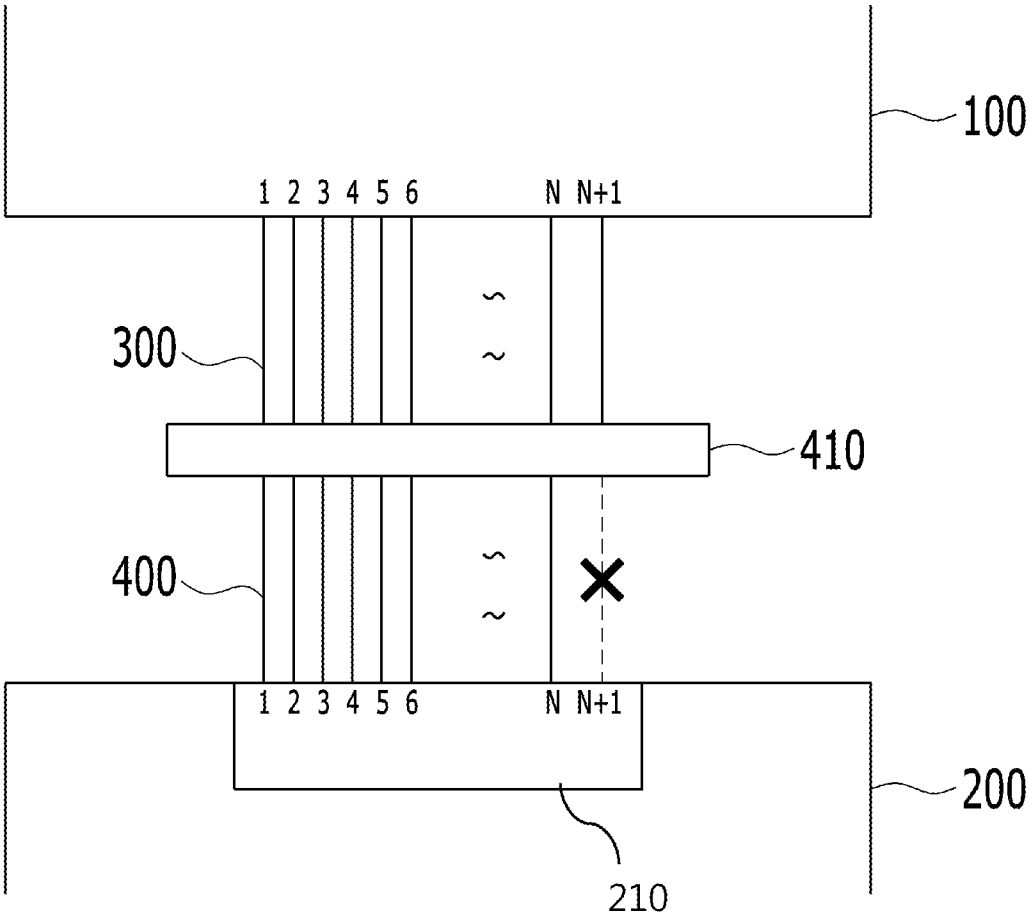

FIGS. 6 and 7 are diagrams illustrating operation of a cable checking unit.

First, FIG. 6 shows the case where the display module 100 and the driver 200 are connected using a basic cable 300. A pin N+1 is added to the basic cable 300 and a status checking signal transmitted through the added pin N+1 is received through the cable checking unit 210, thereby transmitting information indicating that the basic cable is used to the timing controller.

Next, FIG. 7 shows the case where an extension cable 400 is connected to the basic cable 300 using a cable connector 410 to connect the display module 100 and the driver 200. A portion of the harness cable, which is the extension cable 400, is composed of a dummy cable. That is, the cable portion connected to the pin N+1 added to the basic cable 300 is composed of an open-circuited cable. Accordingly, the status checking signal transmitted through the pin N+1 added to the basic cable 300 is not transmitted to the cable checking unit 210. Therefore, the cable checking unit 210 transmits information indicating that the extension cable 400 is used to the timing controller.

That is, when the status checking signal is received through the pin N+1 added to the basic cable, it is determined that the extension cable is not used and, when the status checking signal is not received through the dummy cable connected to the pin N+1 added to the basic cable, it is determined that the extension cable is used.

Using the information detected by the cable checking unit 210, the timing controller 230 reads corresponding optical compensation data from the memory 220. Thereafter, the timing controller 230 applies the read optical compensation data and supplies power to the display module 100.

Although one dummy cable is included in the above example, the number of added pins may be increased depending on various lengths of the extension cable. Therefore, the configurations of the cable connector 410 and the cable checking unit 210 may be changed.

The OLED display device and the optical compensation method thereof according to the present invention have the following effects.

First, it is possible to automatically perform optical compensation according to the use environment of a user.

Second, it is possible to solve optical compensation problems due to use of an additional cable in a display device in which a display module and a driver are separated.

Third, it is possible to solve problems caused by voltage drop occurring due to use of an additional cable in a display device in which a display module and a driver are separated.

It will be apparent to those skilled in the art that various modifications and variations can be made in the OLED display device and optical compensation method thereof of present disclosure without departing from the technical idea or scope of the disclosure. Thus, it is intended that the present disclosure cover the modifications and variations of this disclosure provided they come within the scope of the appended claims and their equivalents.

What is claimed is:

1. An organic light emitting diode (OLED) display device comprising:

a display module including a display panel, a gate driver and a data driver; and a driver spaced apart from the display module to drive the display module, wherein the driver comprises:

a memory for storing optical compensation data according to a length of a cable connecting the display module and the driver;

a cable checking unit configured to receive a basic cable including a plurality of added pins, to check whether a status checking signal is received through the added pins, and to determine that an extension cable is used between the display module and the driver when the status checking signal is not received through the added pins, wherein the memory includes a plurality of optical compensation data respectively corresponding to various lengths of the extension cable used between the display module and the driver; and a timing controller configured to read, from the memory, one of the plurality of optical compensation data stored in the memory corresponding to the length of the extension cable or the length of the cable connecting the display module and the driver, and to control power supplied to the display module based on the read optical compensation data.

2. The organic light emitting diode display device according to claim 1, wherein the memory stores, at different addresses, both optical compensation data according to a length of the basic cable and optical compensation data considering voltage drop due to use of the extension cable.

3. The organic light emitting diode display device according to claim 1, wherein the extension cable is a harness cable.

4. The organic light emitting diode display device according to claim 1, wherein an extension cable portion connected to the added pins is composed of a dummy cable.

5. The organic light emitting diode display device according to claim 1, wherein the timing controller controls the cable checking unit to check whether the extension cable is used and then outputs a control signal to control the power supplied to the display module, when power is applied.

6. An optical compensation method of an organic light emitting diode (OLED) display device in which a display module and a driver are separated, the driver including a timing controller and a memory, and the memory storing a plurality of optical compensation data respectively corresponding to various lengths of an extension cable and a length of a cable used between the display module and the driver, the method comprising:

checking whether the extension cable is used between the display module and the driver;

reading, from the memory, the one of the plurality of optical compensation data corresponding to the length of the extension cable or the length of the cable used between the display module and the driver; and applying the read optical compensation data and supplying power to the display module.

7. The optical compensation method according to claim 6, further comprising:

prior to the checking, calculating and storing optical compensation data according to a length of a basic cable in the memory of the driver; and calculating and storing optical compensation data considering voltage drop due to use of the extension cable in the memory.

8. The optical compensation method according to claim 6, wherein the checking comprises:

determining that the extension cable is not used, when a status checking signal is received through one or more of a plurality of pins added to a basic cable; and determining that the extension cable is used, when the status checking signal is not received through a dummy cable connected to the pins added to the basic cable.

* * * * *